United States Patent [19]

Noguchi et al.

[11] 4,287,859

[45] Sep. 8, 1981

[54] TWO-STROKE CYCLE GASOLINE ENGINE

[75] Inventors: Masaaki Noguchi, Nagoya; Yukiyasu Tanaka; Isao Igarashi, both of Okazaki, all of Japan

[73] Assignee: Toyota Jidosha Kogyo Kabushiki Kaisha, Toyota, Japan

[21] Appl. No.: 917,244

[22] Filed: Jun. 20, 1978

[30] Foreign Application Priority Data

Apr. 28, 1978 [JP] Japan ..... 53-52104

[51] Int. Cl.[3] ..... F02B 1/08

[52] U.S. Cl. ..... 123/51 BA; 123/73 AF; 123/73 A; 123/70 R

[58] Field of Search ..... 123/51 R, 51 B, 51 BA, 123/51 BD, 65 B, 69 R, 70 R, 73 R, 73 S, 73 AF, 73 AE

[56] References Cited

U.S. PATENT DOCUMENTS

| | | | |
|---|---|---|---|
| 1,077,956 | 11/1913 | Fox | 123/70 R |
| 1,077,992 | 11/1913 | McLean | 123/70 R |
| 2,522,649 | 9/1950 | Tenney | 123/70 R |
| 3,847,124 | 11/1974 | Kramer | 123/51 B |
| 3,921,608 | 11/1975 | Kottmann | 123/69 R |
| 3,923,019 | 12/1975 | Yamada | 123/73 R |

FOREIGN PATENT DOCUMENTS

| | | | |
|---|---|---|---|
| 330847 | 10/1935 | Italy | 123/51 BD |
| 229969 | 3/1925 | United Kingdom . | |
| 262098 | 9/1927 | United Kingdom . | |
| 513381 | 10/1939 | United Kingdom . | |
| 538279 | 7/1941 | United Kingdom . | |
| 555974 | 9/1943 | United Kingdom . | |
| 765948 | 1/1957 | United Kingdom . | |
| 1015189 | 12/1965 | United Kingdom . | |
| 1192482 | 5/1970 | United Kingdom . | |

*Primary Examiner*—Craig R. Feinberg

*Attorney, Agent, or Firm*—Finnegan, Henderson, Farabow, Garrett & Dunner

[57] ABSTRACT

A two-stroke cycle gasoline engine including at least one two-stroke cycle power cylinder-piston assembly adopting uniflow scavenging and incorporating two horizontally opposed pistons, and at least one scavenging pump cylinder-piston assembly of the reciprocating type with or without having crankcase compression, wherein the total stroke volume of the scavenging pump means is 1.35 to 1.85 times as large as that of the power cylinder-piston assembly, and the operational phase of the pump cylinder-piston assembly is shifted from that of the power cylinder-piston assembly by an angle of 180° or a little more.

7 Claims, 12 Drawing Figures

TWO-STROKE CYCLE GASOLINE ENGINE

BACKGROUND OF THE INVENTION

The present invention relates to a two-stroke cycle gasoline engine, and, more particularly, to a two-stroke cycle gasoline engine adapted for use with automobiles.

A two-stroke cycle engine has theoretically the advantage that an engine of a certain size can generate a greater power than a four-stroke cycle engine of a bigger size because the two-stroke cycle engine has twice as many work cycles per revolution as the four-stroke cycle engine. In fact, however, the conventional two-stroke cycle gasoline engine employing a carburetor has such drawbacks that it has high fuel consumption as compared with the four-stroke cycle engine due to the loss of air-fuel mixture caused by the direct escape, i.e. blow-out, of scavenging mixture to an exhaust manifold during scavenging, and that it cannot generate such a high power as expected from the fact that it has twice as many work strokes as the corresponding four-stroke cycle engine, due to the fact that the scavenging is still insufficient. Because of these problems, the practical use of two-stroke cycle gasoline engines is nowadays limited to the field of small engines which must be simple in structure and low in manufacturing cost.

Conventional two-stroke cycle gasoline engines of the abovementioned type, therefore, generally employ crankcase compression for scavenging. However, the scavenging by crankcase compression is not fully effective and can only provide a relatively low volumetric efficiency. This is the principal cause of the poor output power of conventional two-stroke cycle gasoline engines. In fact, a volumetric efficiency as high as 80% is available in four-stroke cycle engines, while on the other hand the volumetric efficiency of typical two-stroke cycle engines is still as low as 40–50%. The pump stroke volume of crankcase compression is equal to the stroke volume of the engine. However, since the crankcase has a relatively large clearance volume, the compression ratio of crankcase compression is relatively low, so that as a result the amount of air-fuel mixture drawn to the crankcase is small, the amount of delivered mixture is small, the delivery pressure is low and hence the scavenging pressure is low, and consequently it is hard to supply a really adequate amount of scavenging mixture into the power cylinder. As a result, the delivery ratio obtained in an engine wherein scavenging is effected only by the normal crankcase compression is only as high as 0.5–0.8. Since further the trapping efficiency is about 0.7, the volumetric efficiency becomes as low as 40–50% as mentioned above.

The purpose of scavenging is to push the residual exhaust gases in the power cylinder out of it by fresh mixture, and therefore if the pressure of the residual exhaust gases and the distance between the scavenging port and the exhaust port are given, the time required for completing scavenging is determined, provided that stratified scavenging is performed. Now, if the scavenging pressure is low, as when crankcase compression is used, a relatively long time is required for completing scavenging, particularly when the scavenging is performed by uniflow scavenging, and therefore, when the engine is rotating at high speed, it may well occur that the exhaust port is closed before the scavenging is completed so that a large amount of exhaust gases still remains in the power cylinder, and thereby only a very small amount of fresh mixture is charged into the power cylinder. Therefore, conventional two-stroke cycle engines have been unable to operate satisfactorily in the high speed range.

Therefore, it is an object of the present invention to provide a two-stroke cycle gasoline engine which produces a substantially higher power output per unit volume of the engine displacement when compared with the conventional two-stroke cycle gasoline engine by incorporating a special scavenging pump means in the engine in addition to or, alternatively, without depending upon the crankcase compression, thereby substantially increasing both the amount and the pressure of scavenging mixture so that the volumetric efficiency is increased up to 75–90% or in some cases exceeds 100%.

Another object of the present invention is to reduce the clearance volume of the scavenging means by employing a separate pump means other than the crankcase compression, thereby increasing the scavenging pressure so that the time required for scavenging is so shortened that the scavenging efficiency is increased up to 80–90% and that a high power operation of a two-stroke cycle gasoline engine is ensured even in a relatively high speed operational range.

However, it is to be noted that the relatively high-speed operational region contemplated in the present invention means such an operational region in which the conventional, particularly the uniflow scavenging type, two-stroke cycle gasoline engine is unable to operate with sufficient output power, due to insufficient scavenging at high rotational speed. In fact, the aforementioned relatively high speed rotational region is located in a lower speed region than the high rotational speed region of the conventional automobile four-stroke cycle gasoline engines, as explained below. Therefore, it is still another object of the present invention to provide a two-stroke cycle gasoline engine which can operate in such a lower speed operational region so as to generate sufficient output power. Conventionally, a relatively small-sized four-stroke cycle engine for automobiles is designed so as to be operated at relatively high rotational speed so that relatively high power output is available from a relatively small size engine. In this connection, it is noted that, for example, in the case of an engine which has a two liter piston displacement and produces 92 PS of brake horsepower at 5000 rpm, a very large proportion of the power, such as 52 PS out of the indicated horsepower of 144 PS, is consumed by internal friction losses in the engine. The ratio of the internal friction loss to the output power of the engine is substantially reduced by lowering the rotational speed of the engine. In view of this, still another object of the present invention is to utilize the advantage that the two-stroke cycle engine has twice as many work strokes as the four-stroke cycle engine by increasing the volumetric efficiency of the power cylinder, and to provide an engine which produces a high effective power output per unit stroke volume of the engine without increasing the rotational speed to such a high range as in conventional relatively small four-stroke cycle automobile engines. The maximum rotational speed of the engine contemplated in the present invention is 3800 rpm at the highest.

Methods of scavenging in two-stroke cycle engines are conventionally known as cross scavenging, loop scavenging, and uniflow scavenging. In this connection and in connection with the aforementioned high pressure scavenging contemplated in the present invention, if the scavenging pressure is increased in cross or in loop scavenging, the flow of scavenging mixture is liable to penetrate through the layer of exhaust gases existing in the power cylinder in a short-cutting manner, and also scavenging mixture and exhaust gases may be mixed with each other, thereby not only causing poor scavenging but also increasing the above explained blow-out loss of mixture, thus lowering the volumetric efficiency. On the other hand, it has been experimentally confirmed that when uniflow scavenging is employed, it is possible to push the exhaust gases existing in the power cylinder uniformly out of it by the scavenging mixture at high pressure without causing any detrimental mixing between the scavenging mixture and the exhaust gases, and that in this case if the amount of scavenging mixture is increased so as to be necessary and sufficient, scavenging at high scavenging efficiency is accomplished and, as a result, the volumetric efficiency increases, resulting in corresponding increase of engine output power.

Therefore, it is still another object of the present invention to provide a two-stroke cycle gasoline engine in which high pressure scavenging and uniflow scavenging are combinedly incorporated.

In order to accomplish the aforementioned various objects and features of the present invention, the present invention proposes, as one of its principal features, to incorporate, in a two-stroke cycle engine having at least one two-stroke cycle power cylinder-piston assembly, a scavenging pump means having a total stroke volume of between 1.35 and 1.85 times as much as that of the power cylinder-piston assembly. Such a scavenging pump means may include a pump mechanism depending upon the crankcase compression. In this case, since the stroke volume of the crankcase compression pump mechanism is equal to that of the power cylinder-piston assembly, an independent pump mechanism is required to have a total stroke volume of between 0.35 and 0.85 times as much as that of the power cylinder-piston assembly. In this connection, for a fixed stroke volume of the scavenging pump means, the scavenging pressure effected by the scavenging pump means changes as the clearance volume of the pumping chamber changes. Particularly the crankcase inevitably has a relatively large clearance volume, and therefore in conventional crankcase compression normally scavenging pressure of only about 0.3 atm (gauge pressure) is available. However, in some engines of improved designs, scavenging pressure of about 0.45 atm is available. By contrast, the present invention contemplates to increase the scavenging pressure at the starting of scavenging in high speed operation of the engine up to about 0.6 atm. The pressure of the residual exhaust gases in the power cylinder after the unaided exhaustion of exhaust gases is about 0.2 atm, and by employing scavenging pressure of the order of 0.6 atm the scavenging of the power cylinder is rapidly accomplished. When the crankcase compression is combined with an independent scavenging pump, the clearance volume of the crankcase affects the amount and the pressure of scavenging mixture. When the clearance volume of the crankcase is small, the stroke volume of the independent scavenging pump may be small, while on the other hand when the clearance volume of the crankcase is large, the stroke volume of the independent scavenging pump must be increased. When the scavenging pump means does not incorporate crankcase compression and is completely dependent upon an independent scavenging pump, since the clearance volume of the independent scavenging pump is generally small, the adjustment between the amount and the pressure of scavenging mixture may be made by a mixture tank connected to the delivery port of the scavenging pump. For example, if it is assumed that the delivery amount of a scavenging pump is 70% of its stroke volume, that crankcase compression is not incorporated and that the pump has a stroke volume of 1.85 times as much as the engine stroke volume, then the delivery amount of the pump is 1.3 times as much as the engine stroke volume. However, the mixture discharged from the pump is partly trapped in the mixture tank or passages, and all of the mixture delivered from the pump is not effectively used for scavenging. Therefore, it must be noted that even when the ratio of pump stroke volume to engine stroke volume is the maximum, i.e. 1.85, the delivery ratio is of the order of 1.3 or less. However, in accordance with the present invention, the delivery ratio is substantially larger than that available by conventional crankcase compression, which is of the order of 0.5–0.8.

Even when crankcase compression is employed in accordance with the present invention, it is desirable that the crankcase clearance volume is made as small as possible. Normally the crankcase clearance volume is 2–3 Vs, wherein Vs is engine stroke volume, and therefore the compression ratio is 1.5–1.3. However, if special designs such as involving filling up the back of the piston are incorporated, the clearance volume can be reduced to the order of 1.3 Vs, so that the compression ratio is 1.75. Therefore, when crankcase compression is combined with an independent scavenging pump of the minimum volume (0.35 Vs), if it is assumed that the total clearance volume is, for example, 2 Vs, a compression ratio of the order of 1.6 is available, i.e. $(2+1.35)/2=1.675$. Furthermore, if the delivery ratio available by crankcase compression only is 0.8, the delivery ratio is increased up to the order of 1.0, i.e. if the ratio of the delivery amount of the 0.35 Vs independent pump to the stroke volume thereof is 70%, $0.35\ Vs\times 0.7=0.245\ Vs$, and this scavenging mixture having the volume of 0.245 Vs in the atmospheric condition is added to the amount of scavenging mixture obtained by the crankcase compression only. When crankcase compression is not combined with the independent scavenging pump of the present invention, the amount and the pressure of scavenging mixture are more freely designed than in the case of incorporating the crankcase compression, by adjusting the volume of a mixture tank and of scavenging passages.

The aforementioned condition with regard to the total stroke volume of the scavenging pump means, i.e. the ratio of between 1.35–1.85 of the total stroke volume of the scavenging means to that of the power cylinder-piston assembly, has been obtained from the above-explained considerations and experimental researches based upon those considerations. If the total stroke volume of the scavenging pump exceeds 1.85 times the total stroke volume of the power cylinder, even when the volumetric efficiency of the pump and the ineffective part of the delivered mixture which is trapped in the crankcase, in a mixture tank and in passages are taken into consideration, and even when uniflow scavenging is employed, the delivery ratio becomes so high that the blow-out of the mixture to the exhaust manifold increases up to an undesirable extent. On the other hand, the value of 1.35 for the ratio of the total stroke volume of the pump to the total stroke volume of the power cylinder is, in consideration of the volumetric efficiency of the pump and the ineffective part of the mixture delivered from the pump, the lower limit allowable for accomplishing the object of the present invention which is to obtain a high scavenging efficiency by uniflow scavenging coupled with high flow and pressure of scavenging mixture obtained by the combination of the crankcase compression having a relatively small clearance volume and an independent scavenging pump. When crankcase compression is not combined, the flow and the pressure of scavenging mixture required for accomplishing the objects of the present invention can be more freely determined within the range between the aforementioned upper and lower limits when compared with the case of combining crankcase compression.

Furthermore, currently there exists a great demand for the development of cars which have low fuel consumption, in view of energy saving. Furthermore, cars must satisfy a high standard with regard to the prevention of air pollution. In order to improve fuel consumption, not only the improvement of the fuel consumption of the engine itself but also the reduction of the weight and the air resistance of the vehicle are required. We noted, in connection with various running tests carried out to prepare for the qualification tests for conforming to the standards for the prevention of air pollution which are becoming more severe nowadays, that fuel consumption is different in summer and in winter due to the difference of atmospheric air density, and we more keenly recognized that the air resistance of the vehicle has an important effect on the fuel consumption of the vehicle even in low speed running. In order to lower the air resistance of the vehicle it is important to reduce the height of the vehicle as much as possible and to form the external shape of the vehicle in a streamlined shape. Particularly it is very effective to lower the engine hood. In order to reduce the height of the vehicle it is effective to eliminate the drive shaft for driving the rear wheels so that the shaft tunnel is eliminated and a flat floor is available, over the entire floor area, thereby constructing a vehicle body having a low floor and a low roof. A method for accomplishing this is to employ the FF system, i.e. the front engine-front drive system. In order to lower the engine hood by a large amount in an automobile of FF system while ensuring necessary leg room for the driver and the front seat passenger, it is necessary to reduce substantially the height and length of the engine compartment. Furthermore, in order to reduce the air resistance of the vehicle, it goes without saying that the frontal area of the vehicle must be reduced. Therefore, the width of the vehicle should be minimized. Furthermore, since the transmission, differential gears, and other driving mechanisms must be housed in the engine compartment together with the engine, in the FF system, the space allowed for the engine is much reduced. Light trucks are often designed with the engine mounted under the driver's seat, and in such a design the engine, being relatively long, often extends so far backward as to make a hump of the engine enclosure rearward of the cabin, thus shortening the deck.

It is therefore still another object of the present invention to deal with the aforementioned problems and requirements and to provide a small size gasoline engine having a low height, a small length and not a very large width yet being capable of generating high power.

As uniflow scavenging engines are known an engine having horizontally opposed pistons, an engine having an exhaust poppet valve, etc. In order to accomplish the aforementioned objects of the present invention, we now consider an engine having horizontally opposed pistons. That is, it is found that an engine having a power cylinder-piston assembly employing horizontally opposed pistons is particularly advantageous.

Therefore, in order to accomplish the aforementioned object, the present invention proposes to employ at least one two-stroke cycle power cylinder-piston assembly incorporating uniflow scavenging and two horizontally opposed pistons as the power cylinder-piston assembly of the engine. By combining such a power cylinder-piston assembly with the aforementioned concept of high flow and pressure of scavenging mixture, it is possible to charge the power cylinder with fresh mixture with high volumetric efficiency without causing substantial blow-out of scavenging mixture to the exhaust manifold, and because of this it is possible to obtain an engine of reduced height and length having the high power generating ability even at a relatively low rotational speed, when compared with a conventional four-stroke cycle engine. Furthermore, in contrast to the emission performance of the conventional two-stroke cycle gasoline engine, which shows high concentration levels of HC in the exhaust gases, such as 5–10 times as high as those of the conventional four-stroke cycle gasoline engine, the engine of the present invention is able, due to substantial avoidance of blow-out of scavenging mixture to the exhaust manifold, to keep HC concentration in the exhaust gases at a sufficiently low level.

In connection with the aforementioned concept of employing at least one two-stroke cycle power cylinder-piston assembly incorporating uniflow scavenging and two horizontally opposed pistons as the power cylinder-piston means of the engine, the present invention further proposes to employ at least one pump cylinder-piston assembly of the reciprocating type as the scavenging pump means. By employing such a pump cylinder-piston assembly it is possible to secure the necessary amount and pressure of scavenging mixture even in low speed operation and it is also possible to construct the scavenging pump with a simpler and less expensive structure. When compared with this, if a rotary pump is employed, scavenging pressure is constantly applied to the scavenging port even during the non-scavenging period, whereby it happens that scavenging mixture leaks through the clearance between the power cylinder and the piston, thereby increasing the pumping loss. Furthermore, if the rotary pump is a centrifugal pump, although its structure is simple, there is the problem that the flow of scavenging mixture is insufficient in starting and low speed operations. In contrast to the rotary pump, the reciprocating pump is readily adapted with a proper phase difference to be synchronized with the power cylinder-piston assembly, so that the required scavenging pressure is generated only when the power cylinder-piston assembly is to be scavenged. In this connection, furthermore, if a pump cylinder-piston assembly incorporating horizontally opposed pistons is employed as a reciprocating pump in combination with the aforementioned two-stroke cycle power cylinder-piston assembly incorporating uniflow scavenging and horizontally opposed pistons, another advantage is obtained in that more desirable harmony between the dimensions of the power cylinder-piston assembly and of the pump cylinder-piston assembly is available.

In more detail, a two-stroke cycle power cylinder-piston assembly incorporating uniflow scavenging and horizontally opposed pistons has a volume to be scavenged slightly more that twice as much as the stroke of the individual pistons. Therefore, if the power cylinder-must be scavenged by a scavenging pump having a single piston, either the diameter of the pump cylinderor the stroke of the pump piston must be relatively large. In either case, in view of the fact that the total stroke volume of the scavenging pump means is to be 1.35–1.85 times as large as the total stroke volume of the power cylinder-piston assembly, particularly when crankcase compression is not employed, it is apprehended that either the width or the length of the scavenging pump means may become too large compared with those of the power cylinder-piston assembly. However, if the scavenging pump means is provided as a pump cylinder-piston assembly having horizontally opposed pistons, it is possible to maintain both the diameter of the pump cylinderand the stroke of the pump piston within reasonable values so as to provide desirable harmony with the power cylinder-piston assembly. When such a pump cylinder-piston assembly is arranged horizontally side by side with a power cylinderpiston assembly of the same type having horizontally opposed pistons, the engine presents a compact overall configuration like a horizontally flat block, rectangular in a plan view.

An engine for a small size or light automobile will comprise, at the most, one or two two-stroke cycle power cylinder-piston assemblies of the aforementioned type incorporating uniflow scavenging and horizontally opposed pistons. In this case the balancing of the scavenging pump is important. Even when an independent scavenging pump is relatively small due to use of crankcase compression, if one power cylinder-piston assembly incorporating uniflow scavenging and horizontally opposed pistons is served by a single cylinder-single piston scavenging pump, the pump piston will become relatively large, requiring a relatively large counterweight, resulting in a relatively large crankcase, yet perfect balancing of reciprocating masses will not be attained. In this respect, if the pump is a cylinder-piston assembly having horizontally opposed pistons, the inertia forces of the reciprocating masses related to individual opposed pistons are perfectly balanced, whereby the crankcases for individual pistons are substantially reduced in size together with reduction of the height and length of the engine, thereby providing a compact two-stroke cycle engine of the horizontally opposed piston type less prone to vibration.

However, the differences of engine volume and of dynamic balance between a single piston scavenging pump and an opposed piston scavenging pump will become less important as the engine becomes smaller, while on the other hand, if the engine becomes smaller, the difference in manufacturing cost, which is governed by structural complexity, will become more important. Therefore, it must be individually examined according to various conditions which of the two factors should have priority over the other.

When a pump cylinder-piston assembly having horizontally opposed pistons is employed as the scavenging pump means, the reciprocating inertia forces in the pump means are well balanced, and this, in combination with a power cylinder-piston assembly of the same horizontally opposed piston type in which the reciprocating inertia forces are also well balanced, can provide a well balanced, less prone to vibration, and quiet engine.

With respect to a pair of crankshafts of the power and pump cylinder-piston assemblies of the horizontally opposed piston type, if they are rotated in opposite directions, moments produced by forces perpendicular to the crankshafts are also balanced. However, this requires incorporating a rotation reversing mechanism including an idle gear between the two crankshafts, and therefore increases manufacturing cost. Therefore, as an embodiment of the present invention, it is proposed to drivingly connect a pair of crankshafts of the power and pump cylinder-piston assemblies of the horizontally opposed piston type simply by an endless chain so that the two crankshafts rotate in the same direction. In this regard, it is a matter of choice between pursuing quietness of vibration in engine operation and pursuing reduction of cost to select the system of mutual counter-rotation of a pair of crankshafts or to select the system of rotation in the same direction of a pair of crankshafts, and this is, in any event, a matter of design with regard to the engine of the present invention.

When the two-stroke cycle gasoline engine of the present invention comprises, for example, two two-stroke cycle power cylinder-piston assemblies, and if the crankcases of these power cylinder-piston assemblies are not utilized for crankcase compression of scavenging mixture, the scavenging pump means to serve for the two power cylinder-piston assemblies must have a relatively large capacity. Therefore, even when the scavenging pump is constructed as a pump cylinder-piston assembly having horizontally opposed pistons, a single acting pump cylinder-piston assembly of the horizontally opposed piston type will not be sufficient to supply the necessary flow of scavenging mixture. Furthermore, when two power cylinder-piston assemblies are combined to operate with phase difference of 180° therebetween, another difficulty is encountered with regard to the matching of the operational phase of the scavenging pump to that of the power cylinder-piston assemblies. In view of these problems, the present invention further proposes to employ a double acting pump cylinder-piston assembly having horizontally opposed pistons so as to make the two actions of the pump pistons serve for the scavenging of the first and second power cylinder-piston assemblies, respectively. By this arrangement, it is possible to supply scavenging mixture to two power cylinder-piston assemblies by using one pump cylinder-piston assembly while maintaining harmony between the dimensions of the power cylinder-piston assemblies and of the pump cylinder-piston assembly, and thus an engine having high power output relative to its volume is obtained.

It is not indispensable that the power cylinder-piston assembly of the uniflow scavenging and horizontally opposed piston type and the pump cylinder-piston assembly incorporated in combination in the engine of the present invention should be synchronized with each other with a strict 180° phase difference therebetween in a manner such that when the power piston is in its bottom dead center, the pump piston is in its top dead center. On the contrary, it is possible to obtain a more desirable effect by modifying the phase difference between the power and pump pistons slightly from 180°. In more detail, by shifting the phase of the pump piston relative to the power piston so that, when the power piston is in its bottom dead center, the pump piston is slightly before its top dead center, by, for example, about 15°, i.e. by retarding the phase of the pump piston slightly more than 180° from the power piston, the performance of scavenging in the scavenging period in which the power piston has passed its bottom dead center can be somewhat improved.

In the present description, the top dead center (TDC) of the pump piston means the dead center of the pump piston at the end of pump compression stroke. As a conventional technique for supplementing insufficiency of scavenging by the crankcase compression, it has been proposed to employ a stepped piston. In this case, however, due to incorporation of a scavenging pump cylinderbetween the power cylinderand the crankcase, the length of the cylinder-piston assembly is substantially increased, and the weight of the piston is also increased, thereby causing, as a matter of course, weight increase of the connecting rod and of the crank arm, thereby increasing the weight of the counterweight, which causes a size increase of the crankcase. Therefore, a power cylinder-piston assembly incorporating uniflow scavenging and horizontally opposed stepped pistons will have an abnormally large width when it is used as an automobile engine and will not be suitable for being mounted in the engine compartment of a small size or light automobile. Further, in the present description the total stroke volume of the engine or of the power cylinder-piston assembly means the sum of the total volumes displaced by the power pistons while they move from their bottom dead center (BDC) to their top dead center (TDC). Therefore, the effective stroke volume, which is the sum of the volumes displaced by the power pistons when they move from the point where the exhaust ports are just closed by the power piston to their TDC, is smaller than the total stroke volume. When two or more power cylinder-piston assemblies are included in the engine, the total stroke volume of the engine is the value which is obtained by multiplying the number of the power cylinder-piston assemblies by the above-defined total stroke volume of each power cylinder-piston assembly. The total stroke volume of the pump means the sum of the volumes displaced by the pump pistons while it moves from BDC to TDC during its compression stroke.

SUMMARY OF THE INVENTION

In view of the various problems with regard to the conventional art and of the various objects and features of the present invention discussed above, in summary the present invention proposes a two-stroke cycle gasoline engine comprising at least one two-stroke cycle power cylinder-piston assembly incorporating uniflow scavenging and two horizontally opposed pistons, and a scavenging pump means including at least one pump cylinder-piston assembly of the reciprocating type driven by said power cylinder-piston assembly in synchronization therewith, wherein the total stroke volume of said scavenging pump means is between 1.35 and 1.85 times as large as that of said power cylinder-piston assembly and the operational phase of a pump cylinder-piston assembly is so shifted relative to that of the power cylinder-piston assembly to which it supplies scavenging mixture that, when the power cylinder-piston assembly is at its bottom dead center, the pump cylinder-piston assembly is at or slightly before its top dead center.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
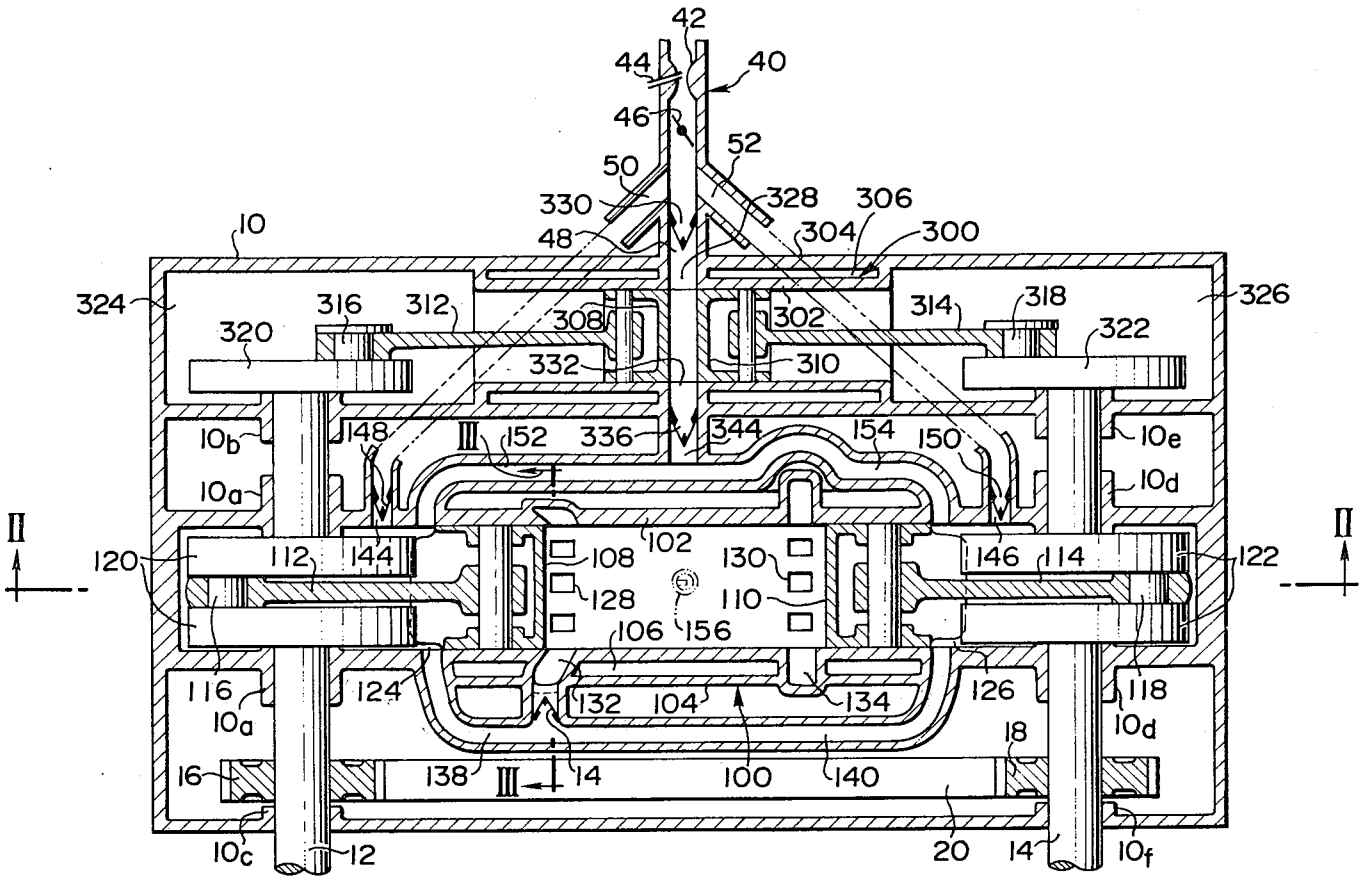
FIG. 1 is a diagrammatical plan sectional view showing a first embodiment of the two-stroke cycle gasoline engine of the present invention.
Figure 2:
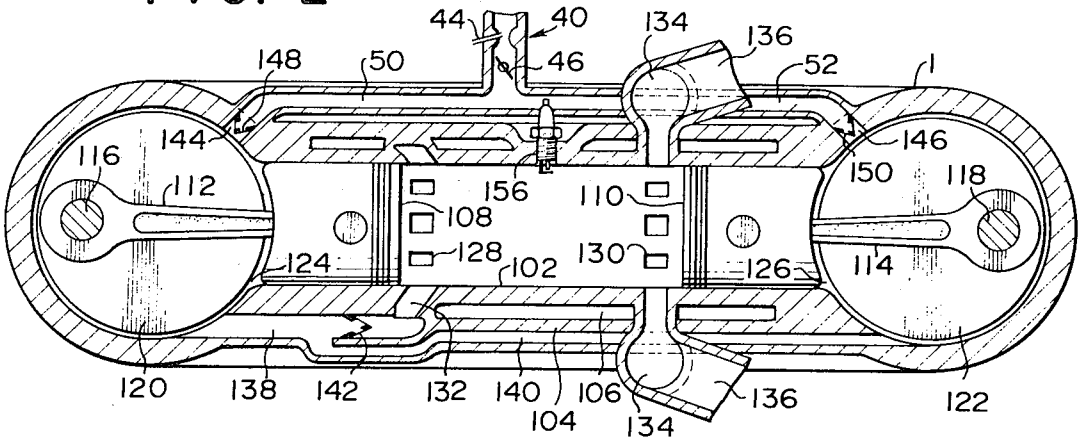
FIGS. 2 and 3 are sectional views along lines II—II and III—III in FIG. 1, respectively.
Figure 3:
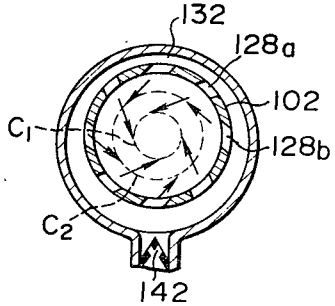

Referring first to FIGS. 1-3, showing the first embodiment of the present invention, the two-stroke cycle gasoline engine herein shown comprises a cylinderblock 10, the overall shape of which is like a relatively flat block, rectangular in a plan view, and adapted to be installed with its two largest facets arranged horizontally. In the cylinderblock there are provided a pair of crankshafts 12 and 14 which are arranged along the opposite edges of the cylinderblock and are rotatably supported by bearings 10*a*–10*c* and 10*d*–10*f*, respectively. In this embodiment, for example, the crankshaft 12 may be connected to auxiliaries of the engine, while on the other hand the crankshaft 14 may serve as the power output shaft of the engine. In the cylinderblock 10 there are incorporated a power cylinder-piston assembly 100 and a scavenging pump means 300, which is in this embodiment an independent pump cylinder-piston assembly having horizontally opposed pistons.

First, the power cylinder-piston assembly 100 will be described. The assembly includes a power cylinder 102 supported by the cylinderblock 10. The power cylinder is surrounded by a cooling jacket 106 defined by a jacket wall 104. In the cylinder102 are arranged two power pistons 108 and 110, one being located on the scavenging side or the left side in the figure while the other is located on the exhaust side or the right side in the figure. The pistons 108 and 110 are individually connected with connecting rods 112 and 114, which in turn are individually connected with crankpins 116 and 118, respectively. The crankpins 116 and 118 are individually supported by crank arms 120 and 122, each of which has a disk shape. The two crank mechanisms each including the disk-shaped crank arms and the crank pin are individually housed in crankcases 124 and 126 having a corresponding internal shape so that regardless of rotational angle of the crank the principal internal space of each crankcase is occupied by the crank means so as to reduce the clearance volume of the crankcase of the minimum value.

Figure 4:
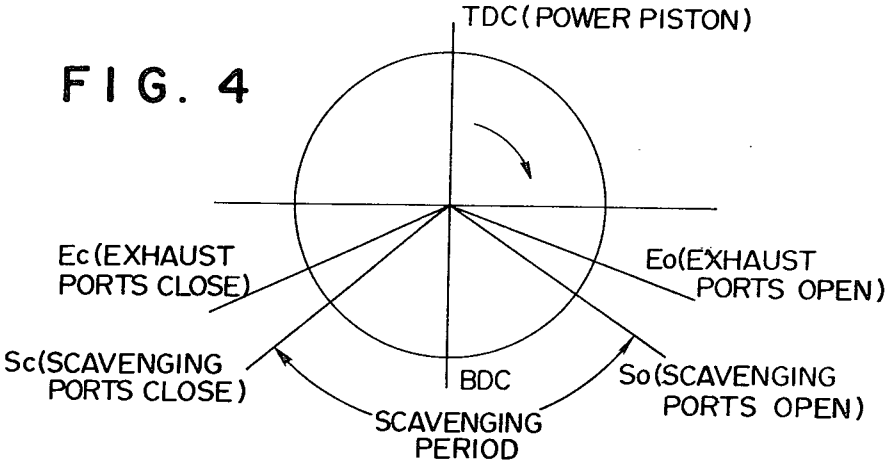
FIG. 4 is a crank angle diagram showing the phases of opening and closing of the scavenging port and the exhaust port of the engine shown as the first embodiment of the present invention.

The cylinder102 has a plurality of scavenging ports 128 in its scavenging side and a plurality of exhaust ports 130 in its exhaust side. These scavenging ports and exhaust ports are connected with a scavenging plenum 132 and an exhaust plenum 134, respectively. The exhaust plenum 134 is connected with exhaust pipes 136. As shown in FIG. 3, the scavenging ports 128 are composed of two groups of scavenging ports, wherein the first group of scavenging ports 128*a* open along axes tangential to a first phantom cylinderC1 coaxial with the cylinder102 and having a relatively small diameter, while on the other hand the second group of scavenging ports 128*b* open along axes tangential to a second phantom cylinderC2 coaxial with the cylinder102 and having a relatively larger diameter than said first phantom cylinder. Furthermore, the scavenging ports 128*a* and 128*b* are inclined toward the exhaust side of the cylinderso that the flows of scavenging mixture discharged from these scavenging ports have a velocity component toward the exhaust ports 130. The phases of opening and closing of the scavenging ports 128 and the exhaust ports 130 are determined as shown in FIG. 4. Thus scavenging mixture discharged from these scavenging ports 128*a* and 128*b* flows through the cylinder102 toward the exhaust side by forming a spiral flow. The scavenging plenum 132 is connected with the crankcases 124 and 126 by way of passages 138 and 140, respectively. In the joining portion of the scavenging plenum 132 and the passages 138 and 140 is provided a reed valve 142 which allows fluid to flow only from the passages toward the scavenging plenum so that blowback of combustion gases from the power cylinderis prevented. The reed valve may be omitted if there is no danger of causing such blowback.

Next, the pump 300 will be described. The pump includes a pump cylinder302 supported by the cylinderblock 10. The pump cylinder302 is surrounded by a cooling jacket 306 defined by a jacket wall 304. This cooling jacket serves to remove the compression heat of mixture generated in the pump 300 so as to increase the volumetric efficiency of the pump, while further when the engine is operated in cold weather, it serves to warm the pump cylinderso as to expedite atomization of the gasoline. For these purposes, the cooling jacket 306 is connected with the cooling jacket 106 of the power cylinderby a passage means not shown in the figure. In the pump cylinder302 are provided a pair of pump pistons 308 and 310 opposed to each other. The pistons 308 and 310 are individually connected with connecting rods 312 and 314, which in turn are individually connected with crankpins 316 and 318. The crankpins 316 and 318 are individually supported by crank arms 320 and 322 which, in the shown embodiment, are individually formed as cantilever type crank arms for the purpose of reducing the weight of the engine. The crank mechanisms composed of the connecting rods, crank pins, and crank arms are individually housed in crank cases 324 and 326 which are connected with the internal space of an air cleaner (not shown in the figure) by positive crankcase ventilation valves (also not shown in the figure).

The crankshafts 12 and 14 are drivingly connected with each other by way of sprocket wheels 16 and 18 individually mounted on said two crankshafts and an endless chain 20 engaged around the sprocket wheels so that the two crankshafts rotate in the same rotational direction at the same rotational speed. The phase relation between the two crankshafts is so determined that the crankpins 116 and 118 individually related to the power pistons 108 and 110 are shifted from each other by 180°. Depending upon such a phase relation between the crankshafts 12 and 14, the phase relation betweeen the crankpins 316 and 318 individually related to the pump pistons 308 and 310 is so determined that the crankpins are shifted from each other by 180°. Furthermore, the phase relation between the crankpin 116 related to the power piston 108 and the crankpin 316 related to the pump piston 308 and the phase relation between the crankpin 118 related to the power piston 110 and the crankpin 318 related to the pump piston 310 are determined so as to incorporate a phase difference therein which is 180° or approximately 180°. However, as explained in detail below, in some cases it is more desirable to design this phase difference in a manner such that, when the power piston is at its bottom dead center, the pump piston is slightly before its top dead center. The extent of this retardation of the pump piston relative to the power piston is up to about 15°, in consideration of interference which will be caused by the phase difference between compression and intake performed by the pump 300 and the crankcases 124 and 126. By retarding the top dead center of the pump pistons 308 and 310 relative to the bottom dead center of the power pistons 108 and 110 in the aforementioned manner, the scavenging period after the power pistons have passed the bottom dead center, which is not effectively utilized when such a retardation is not provided, can be effectively utilized for continued scavenging.

40 designates a carburetor which includes a venturi portion 42, a main fuel nozzle 44 which opens to the throat portin of the venturi portion, and a throttle valve 46, and takes in air from its air inlet port located upward in the figure and produces fuel-air mixture in the usual manner. The mixture output port of the carburetor 40 is connected with an inlet port 328 of the pump 300 by way of a passage 48 and is also connected with inlet ports 144 and 146 of the crankcases 124 and 136 by way of passages 50 and 52, respectively. In the port 328 is provided a reed valve 330 which allows fluid to flow only towards the pump chamber. Similarly, in ports 144 and 146 are provided reed valves 148 and 150, respectively, each allowing fluid to flow toward its crankcase. An outlet port 332 of the pump 300 is connected with the crankcases 124 and 126 by way of a common passage 334 and branch passages 152 and 154, respectively. In the port 332 or at the middle portion of the passage 334 is provided a reed valve 336 which allows fluid to flow only toward the crankcases.

Although in FIG. 1 the carburetor 40, passages 50 and 52, ports 144 and 146, passages 344, 152, and 154, and passages 138 and 140 are shown as developed in a plan view for the convenience of illustration, in the actual engine it is desirable that these means or structures should be three-dimensionally constructed in the following manner. With respect to the passages 138 and 140, it is desirable that these passages open individually between a pair of crank arms 120 and 122 so that th flow of mixture introduced into the crankcase is not obstructed by the crank arm 120 or 122 and the piston 108 or 110. When the engine is in the cold state, liquid fuel accumulates in the bottom of the crankcase. Therefore, it is desirable that the passages 138 and 140 should open to the bottoms of the crankcases so that they can readily take out the accumulated fuel. It is also desirable that the ports 144 and 146 should open between the pair of crank arms 120 and 122 so that the flow of mixture is not obstructed by the arms 120 and 122. When the engine is in the cold state, the carburetor 40 provides poor atomization of fuel, and fuel droplets will be discharged into the passages 48, 50 and 52. Therefore, it is desirable that the carburetor should be located above the pump or the crankcases of the power cylinder-piston assembly so that such fuel droplets can flow into the pump chamber or the crankcases by the action of gravity. Such an arrangement is shown in FIG. 2. Furthermore, as seen in FIG. 1, it is desirable that the power assembly 100 and the pump assembly 300 should be arranged as close to one another as possible. In this connection, therefore, it is desirable that the passages 152 and 154 should be arranged through the clearance left between the power assembly 100 and the pump assembly 300. The ports through which the passages 152 and 154 open individually to the crankcases 124 and 126 may be located so as to oppose the crank arms 120, 122 or the pistons 108, 110, if the ports are adapted so as not to be strongly throttled, because the mixture supplied through the passages 152 and 154 is pressurized by the pump.

An ignition plug 156 is provided at a longitudinally central portion of the power cylinder 102.

Figure 5:
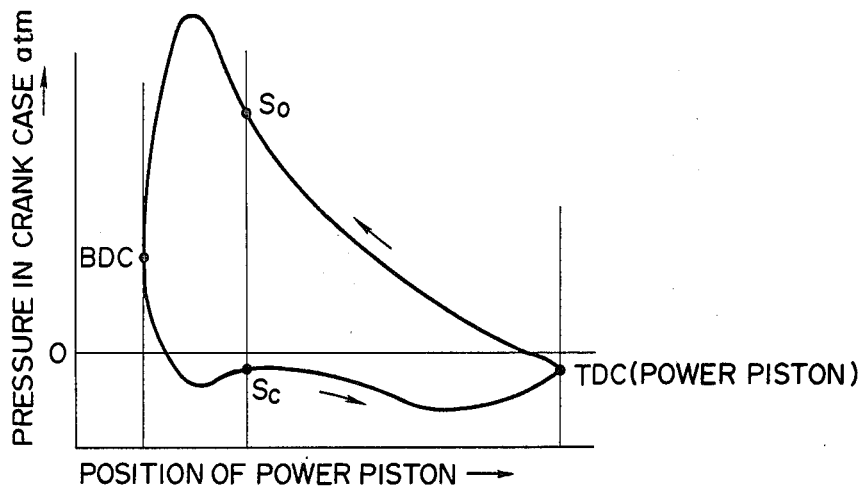
FIG. 5 is an indicator diagram showing the crankcase pressure of the engine shown as the first embodiment of the present invention.

In this embodiment the scavenging pump means is composed of the crankcases 124 and 126 of the power assembly and the independent pump assembly 300. The total stroke volume of such a scavenging pump means is, as mentioned above, 1.35–1.85 times as much as the total stroke volume of the power assembly 100. Therefore the stroke volume of the pump assembly 300 is 0.35–0.85 times as much as the total stroke volume of the power assembly. A particular ratio of the stroke volume of the pump assembly 300 to that of the power assembly within the aforementioned range is determined in the following manner. First, the rotational speed of the engine which most frequently occurs when the engine is being operated in the full throttle condition is estimated, and based upon this rotational speed the stroke volume of the pump assembly 300 is determined so that when scavenging mixture has just pushed exhaust gases out of the exhaust ports 130, the exhaust ports should be closed by the exhaust side piston 110. The mixture delivered from the pump assembly 300 is introduced into the crankcases 124 and 126 which perform pumping action so that the pressure in the crankcases changes as shown in FIG. 5 in accordance with reciprocation of the power pistons 108 and 110, wherein the crankcase pressure is expressed by gauge pressure. The mixture compressed in the crakcases is discharged from the scavenging ports 128 in the power cylinder 102 at the pressure at the time point So (also see FIG. 4) where the scavenging ports are opened. The mixture is slightly throttled while it passes through the scavenging ports, and thereafter the mixture flows toward the exhaust ports 130 while forming a spiral flow, and is finally discharged from the exhaust ports. The time required for the scavenging mixture to reach the exhaust ports is determined by the pressure difference between the scavenging mixture and the combustion gases remaining in the power cylinder and the spiral distance between the scavenging ports and the exhaust ports travelled by the spiral flow of the mixture, whil this time is not directly concerned with the rotational speed of the engine. Therefore, when the shape and the arrangement of the scavenging ports and the exhaust ports are determined, the abovementioned time is determined in accordance with the pressure at So of scavenging mixture and its subsequent change. For a fixed performance of crankcase compression, the scavenging pressure at So is increased as the stroke volume of the independent pump assembly 300 is increased. In this case if the clearance volume of the crankcase is relatively large, the scavenging pressure at So is not much increased, while on the other hand the duration period of existence of relatively high scavenging pressure becomes longer. The volumetric efficiency of a reciprocating piston pump is higher as its reciprocating speed is lower, if the suction inertia effect of the pump is neglected. Therefore, if the engine is matched so that, at a certain rotational speed (this is called matching speed), just when scavenging mixture has pushed exhaust gases out of the exhaust ports, the exhaust ports should be closed, in operation at speeds below this matching speed the blow-out of mixture to the exhaust manifold will occur, while on the other hand in operation above the matching speed exhaust gases will remain in the power cylinder. Therefore, if the engine is to generate high torque in high speed rotation, the stroke volume of the pump assembly 300 must be increased so as to increase the scavenging pressure. In this case, however, the blow-out of mixture to the exhaust manifold will increase in low speed full throttle operation. When the exhaust pipe has substantial exhaust inertia effect, this also affects the time required for scavenging mixture to reach the exhaust ports. If the scavenging pressure is too high, it causes mixing up of scavenging mixture and exhaust gases so as to increase blow-out of mixture to the exhaust manifold thereby lowering scavenging efficiency. In consideration of the abovementioned factors an estimation of pump stroke volume is made, and thereafter by the process of experiments the pump stroke volume must be modified so as to satisfy the requirements with regard to engine performance and to the standard for exhaust gas purification. As a result of such experimental researches, we have found that when the ratio of the total stroke volume of the scavenging pump to the total engine stroke volume is in the range of 1.35 to 1.85, the engine of the present invention can satisfy the requirements with regard to engine performance and to the standard for exhaust gas purification in the most desirable manner.

The operation of the embodiment shown in FIGS. 1–3 will be described hereinunder. When the power pistons 108 and 110 individually move from their bottom dead center (BDC) toward their top dead center (TDC), the pump pistons 308 and 310 individually move from their TDC toward their BDC. When the pressure difference across the reed valve 330 overcomes the spring force of the reed valve, the pump 300 begins to draw in mixture through the reed valve. Similarly, when the pressure difference across the reed valves 148 and 150 overcomes the spring force of the reed valve, the crankcases 125 and 126 begin to draw in mixture. Thereafter, when the power pistons 108 and 110 individually move from their TDC toward their BDC, the pump pistons 308 and 310 individually move from their BDC toward their TDC, whereby the pressure in the crankcases 124 and 126 and the pressure in the pump cylinder 302 increase. In this connection, it is to be noted that even when the pump pistons 308 and 310 have passed their BDC, the reed valves 330, 148, and 150 are still open for a while due to the suction inertia effect so that suction of mixture is continued during such a period. As the compression by the pump 300 proceeds, since the compression ratio of the pump is higher than that of the crankcases 124 and 126, the mixture compressed by the pump 300 soon pushes open the reed valve 336 so as to flow into the crankcases 124 and 126. As the power pistons 108 and 110 approach their BDC, first the exhaust ports 130 open (FIG. 4), whereby the exhaust gases existing in the power cylinder 102 are discharged through the exhaust ports into the exhaust plenum 134, wherefrom they are exhausted through the exhaust pipes 136, and the pressure of the residual exhaust gases existing in the power piston 102 rapidly lowers. Then, as the power pistons further proceed toward their BDC, the scavenging ports 128 are opened, whereby compressed mixture is discharged through the scavenging ports into the power cylinder 102 and flows toward the exhaust ports 130 in the form of a spiral flow while pushing the residual gases existing in the power cylinder out of the exhaust ports. The scavenging pressure lowers substantially proportionally to the crankcase pressure shown in FIG. 5. After the power pistons 108 and 110 have passed their BDC, the flow of scavenging mixture into the power cylinder 102 continues for a while due to the inertia effect, although the amount of flow of mixture by this effect is very small. As the power pistons 108 and 110 move toward their TDC, first the scavenging ports 128 are closed by the power piston 108 on the scavenging side, and then the exhaust ports 130 are closed by the power piston 110 on the exhaust side. After this, the compression of the mixture is initiated. Some time before the power pistons reach their TDC, the compressed mixture is ignited by the ignition plug 156, and the mixture is combusted. After the power pistons have passed their TDC, combustion stroke is performed and power is produced. Then the exhaust ports 130 are again opened so that the engine completes an operational cycle. The reed valves 330, 148 and 150 are indispensable for the pump 300 and the crankcases 124 and 126 to perform compression stroke, while on the other hand the reed valve 336 is not necessarily indispensable. Without this, however, since the pump 300 enters into suction stroke after the power pistons 108 and 110 have passed their BDC, the pressure in the crankcases 124 and 126 will undesirably lower. It is desirable that the reed valves 148 and 150 should be positioned so as to be close to the wall of the crankcases so that the clearance volume of the crankcases is reduced.

Although in the above it is described that the power pistons 108 and 110 and the pump pistons 308 and 310 are shifted from each other by 180° so that when one is at TDC, the other is at BDC, this phase difference need not necessarily be 180°. In a crank-piston mechanism of this kind, the rate of change of piston position relative to the change of crank angle is very small when the piston is at its TDC or BDC or in their vicinities. Therefore, even when there exists a phase difference of the order of within about 15° between the pumping structure using crankcase compression and an independent scavenging pump, there occurs no serious problem of the suction stroke of one pumping structure disadvantageously interfering with the compression stroke of the other pumping structure. In fact, in view of the fact that the pressure in the crankcase considerably lowers after the power piston has passed its BDC, as shown in FIG. 5, it is contemplated that by further retarding the phase of the pump piston relative to that of the power piston by an angle within the range of about 15° in addition to a phase difference of 180°, i.e. by retarding the phase of the pump piston by 180°–195° from the phase of the power piston, the scavenging in the latter half of the scavenging period, i.e. after the power piston has passed its BDC, can be somewhat improved.

Figure 6:
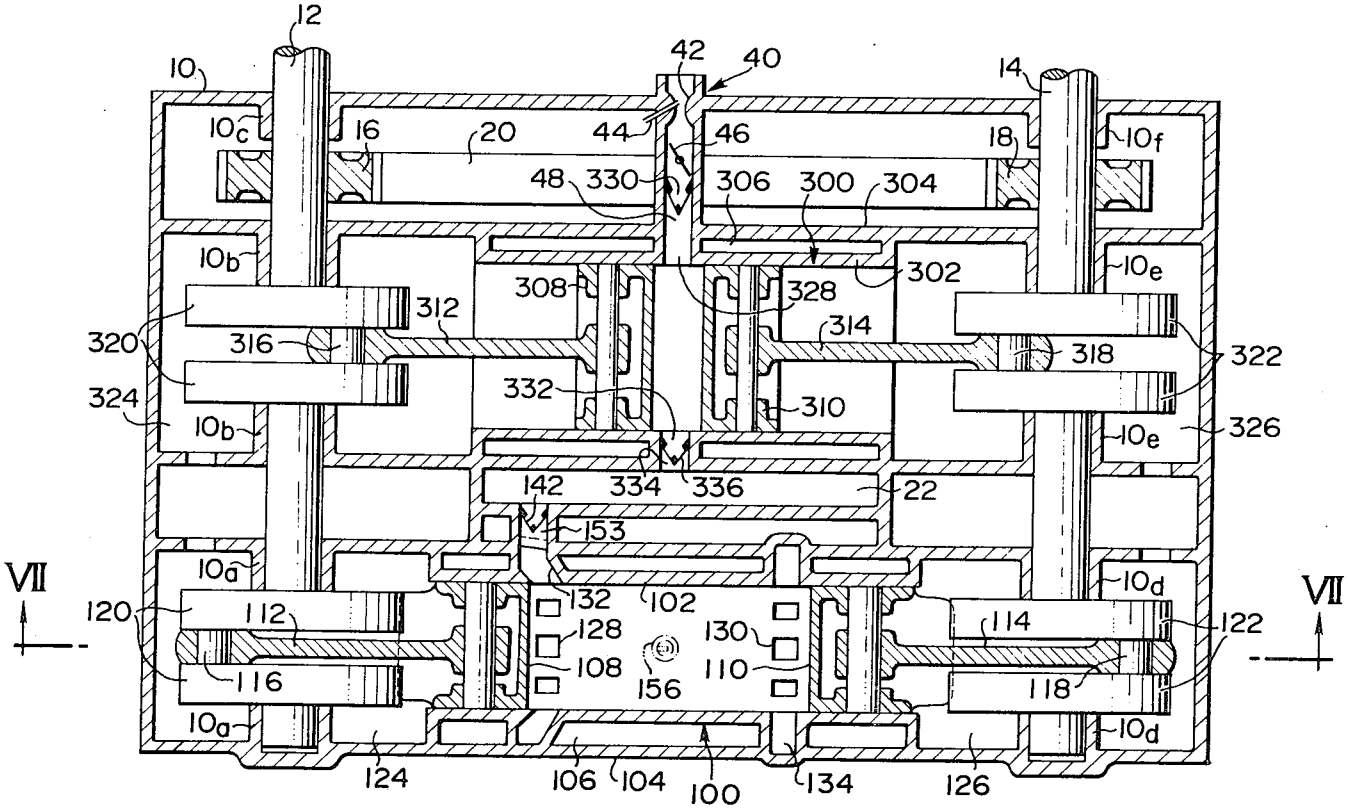
FIG. 6 is a diagrammatical plan sectional view similar to FIG. 1 showing a second embodiment of the present invention.
Figure 7:
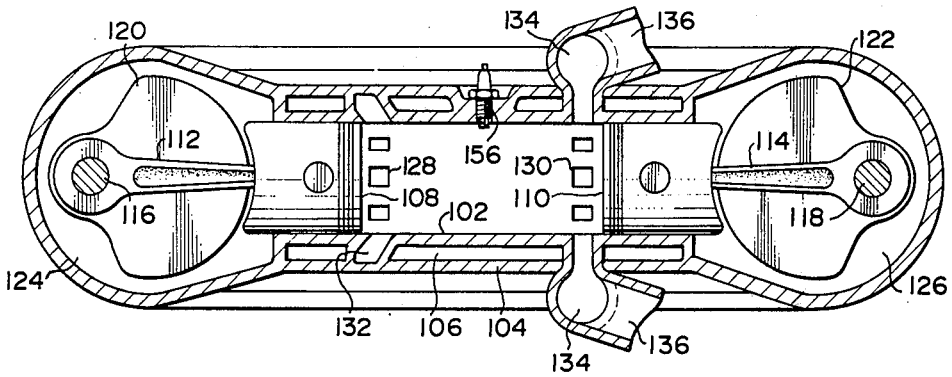
FIG. 7 is a sectional view along line VII—VII in FIG. 6.

FIG. 6 is a view similar to FIG. 1, showing a second embodiment of the present invention, and FIG. 7 is a view similar to FIG. 2 showing a section along line VII—VII in FIG. 6. In these figures the portions corresponding to those shown in FIGS. 1 and 2 are designated by the same reference numerals. In this second embodiment the crankcases 124 and 126 of the power cylinder-piston assembly 100 are not adapted to perform crankcase compression of scavenging mixture. In this case the compression of scavenging mixture is effected only by the pump assembly 300 which, in this embodiment is also constructed as a pump cylinder-piston assembly having horizontally opposed pistons as in the first embodiment shown in FIGS. 1–3. Therefore, as apparent from FIG. 7 the crank arms 120 and 122 are not formed in the disk shape as in the first embodiment, and on the contrary they are so shaped as to provide an eccentric mass system which provides better balance of the crank mechanisms constructed by the pistons 108 and 110, connecting rods 112 and 114, and crank pins 116 and 118. In this case, therefore, the crankcases 124 and 126 are not so shaped as closely to house disk-shaped crank arms as in the first embodiment, because the crankcases may have any large clearance volume.

The pump assembly 300 in this second embodiment has substantially the same structure as the pump assembly in the first embodiment. However, since the second embodiment does not involve crankcase compression, the stroke volume of the pump assembly 300 in the second embodiment must be relatively large so as to be 1.35–1.85 times as large as the stroke volume of the power assembly 100. Therefore, as shown in FIG. 6, if the stroke of the pump pistons is designed so as to be the same as the stroke of the power pistons, the inner diameter of the pump cylinder 302 should be the square root of 1.35–1.85 times as large as the inner diameter of the power cylinder 102. In this case, therefore, the pump pistons 308 and 310 and the connecting rods 312 and 314 become relatively large, and, because of this, in order to support such a relatively large moving mass system in a stable and well balanced condition, the crank arms 320 and 322 are constructed so as individually to have a pair of crank arms. The inertia force of the moving mass system including the piston-crank arms can, due to the horizontally opposed piston structure of the pump cylinder-piston assembly, be internally balanced so as not to give any external effect. However, a relatively heavy load is exerted on the bearing portion of the crankshaft. In view of this, it is also desirable that the crank arms 320 and 322 should individually be constructed by a pair of crank arms which are positively supported on opposite sides thereof. In this connection, in this second embodiment, the crank shafts 12 and 14 individually also serving, for example, as a shaft for driving auxiliaries of the engine and as the engine power output shaft, are extended on the side of the scavenging pump, and on such extended portions the crankshafts 12 and 14 individually have sprocket wheels 16 and 18 and are drivingly connected by an endless chain 20 so that they rotate in synchronization with each other in the same direction. The crankcases 324 and 326 of the pump assembly 300 are individually connected with the crankcases 124 and 126 of the power assembly 100 so that the fluctuations of the crankcase pressure due to reciprocation of the pistons 308 and 310 are cancelled. Furthermore, the crankcases 124 and 126 are connected to the inside of an air cleaner not shown in the figure by way of a positive crankcase ventilation valve also not shown in the figure, as described with reference to the first embodiment.

In this second embodiment involving no crankcase compression the determination of the pump stroke volume relative to the engine stroke volume within the ratio of 1.35-1.85 is made in the same manner as described with respect to the first embodiment. In this case, however, since the pumping system does not include such a large clearance volume as provided by the crankcase compression, a proper clearance volume must be provided by other means, because otherwise scavenging pressure will become so high that undesirable mixing of scavenging mixture and combustion gases will occur, thereby reducing scavenging efficiency. In view of this, in this embodiment, a mixture tank 22 is provided between the pump assembly and the power assembly so that the mixture delivered from the outlet port 332 of the pump is once introduced into the mixture tank through a passage 334, and the mixture is then delivered from the mixture tank to the scavenging ports 128 through a passage 153. By giving a proper volume to the mixture tank 22 the scavenging pressure is properly adjusted. Alternatively, instead of providing a mixture tank such as 22, the necessary clearance volume in the pump system is obtained by properly enlarging the head clearance between the pump pistons 308 and 310.

Figure 8:
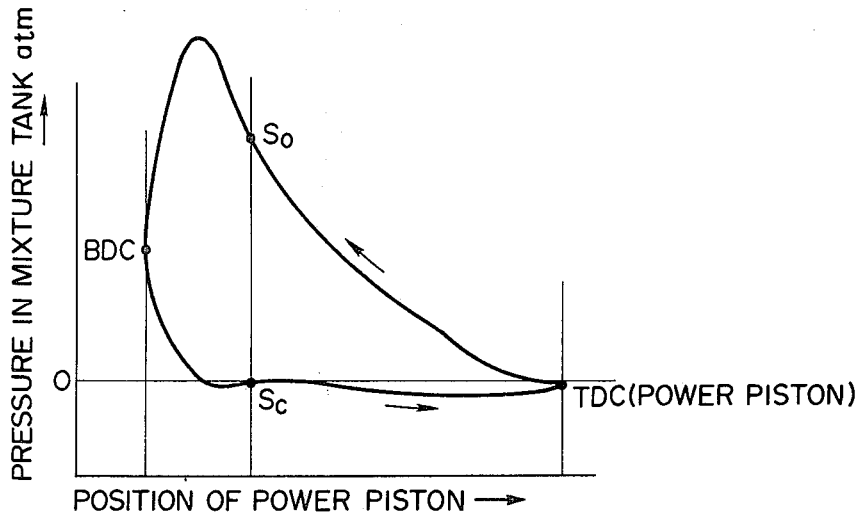
FIG. 8 is a diagram showing the relation between the pressure in the mixture tank and the stroke of the power piston in the second embodiment.

The pressure in the mixture tank 22 changes as shown in the indicator diagram of FIG. 8 in accordance with reciprocation of the power pistons 108 and 110. That is, the pressure of the mixture does not lower so far after the power pistons 108 and 110 have passed their BDC as in the case involving crankcase compression. Therefore the scavenging efficiency is improved when crankcase compression is not involved. Since the reed valve 336 cannot be completely closed, the pressure in the tank 22 is somewhat lowered by the effect of the pump 300, while it is performing the suction stroke. As in the first embodiment, in this second embodiment the stroke volume of the pump assembly 300 and the volume of the tank 22 are determined so that at the matching speed at full throttle opening the exhaust ports 130 are closed just when scavenging mixture has pushed combustion gases out of them, and thereafter in accordance with the process of experiments employing a test engine the stroke volume of the pump is modified so as to satisfy the requirement with regard to engine performance and to the standard for exhaust gas purification. With regard to this second embodiment, it has been confirmed that the aforementioned condition that the total stroke volume of the scavenging pump is 1.35-1.85 times as large as the total stroke volume of the power assembly can provide a two-stroke cycle gasoline engine which satisfies the aforementioned requirements.

In this second embodiment the phase of the pump pistons 308 and 310 may be shifted from that of the power pistons 108 and 110 respectively by a phase difference which is larger than 180° within the range of about 15°, and by such a retardation scavenging performance in the latter half of the scavenging period can be improved.

Figure 10:
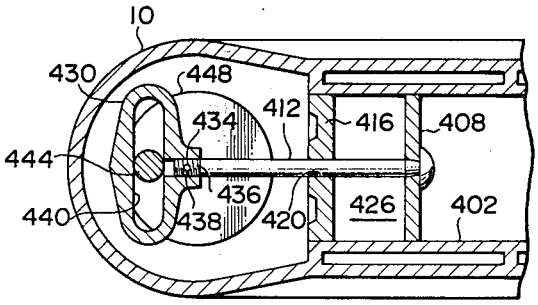
FIG. 10 is a sectional view along line X—X in FIG. 9.
Figure 9:
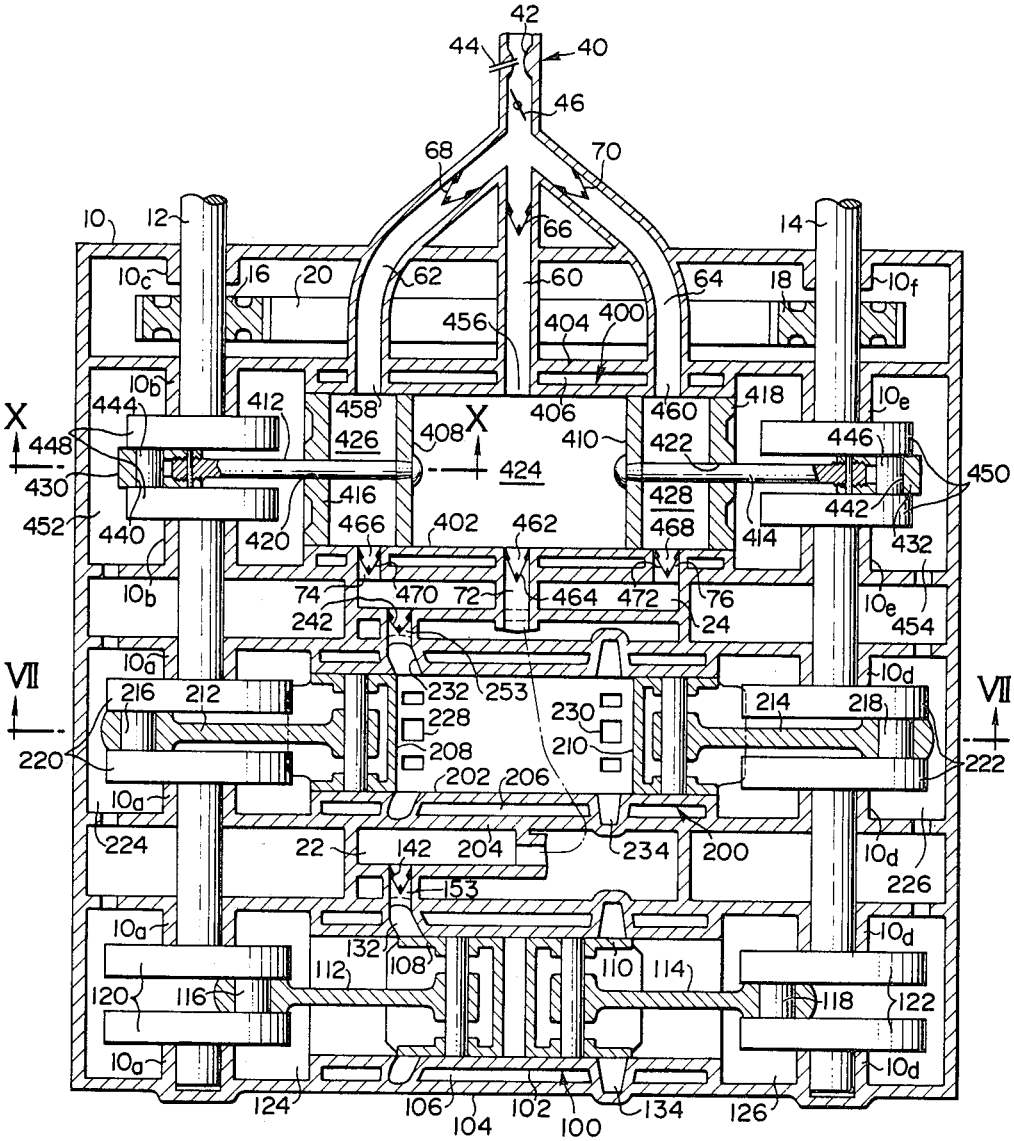
FIG. 9 is a diagrammatical plan view similar to FIGS. 1 and 6, showing a third embodiment of the present invention.

FIG. 9 is a view similar to FIG. 1 or 6, showing a third embodiment of the present invention, and FIG. 10 is a sectional view along line X—X in FIG. 9. In FIGS. 9 and 10 the portions corresponding to those shown in FIGS. 1, 2, 6, and 7 are designated by the same reference numerals. In this third embodiment, in addition to the power cylinder-piston assembly 100 of the two-stroke cycle uniflow scavenging horizontally opposed piston type is incorporated a second power cylinder-piston assembly 200 having substantially the same structure as the first power cylinder-piston assembly 100. In FIG. 9, therefore, the portions of the second power cylinder-piston assembly 200 corresponding to those of the first power cylinder-piston assembly 100 are designated by reference numerals which are the reference numerals attached to the corresponding portions of the first cylinder-piston assembly 100 each increased by 100. As apparent from FIG. 9, the power pistons 108 and 110 of the first power cylinder-piston assembly 100 and the power pistons 208 and 210 of the second power cylinder-piston assembly 200 are individually shifted by a phase difference of 180°.

Further, as apparent from FIG. 9, also in this third embodiment the crankcases 124, 126 and 224, 226 of the power cylinder-piston assemblies 100 and 200 are not used for crankcase compression. In this case, if the scavenging in the two power cylinder-piston assemblies is to be done by a signal action pump cylinder-piston assembly having two horizontally opposed pistons and having a piston stroke comparable with that of the power pistons from the viewpoint of obtaining the overall dimensional harmony of the engine (in this case the power cylinder-piston assemblies 100 and 200 must operate with the same phase), the diameter of the pump cylinder will become very large, and in this regard dimensional harmony between the pump assembly and the power assemblies will not be attained. On the contrary, if the diameter of the cylinder of such a single acting pump cylinder-piston assembly is to be maintained in such a value as to be comparable with the diameter of the power cylinder, the stroke of the pump pistons will become very large so that in this case the crank mechanism of the pump will be incompatible with the crank mechanism of the power assembly. Furthermore, in this case the swing angle of the connecting rod in the pump assembly will become too large to construct a practical pump assembly. These problems will be avoided if two single acting pump cylinder-piston assemblies having horizontally opposed pistons are employed as arranged side by side as the first and second power cylinder-piston assemblies. In this case, however, the length of the engine, i.e. the dimension along the crankshafts, will become relatively large, and this reduces the merit of compactness of the engine.

In view of these problems, in this third embodiment the scavenging pump means, which must supply a relatively large amount of scavenging mixture in accordance with the present invention to the two power cylinder-piston assemblies of the two-stroke cycle uniflowe scavenging opposed piston type without involving crankcase compression, is constructed as a double acting pump cylinder-piston assembly 400 having two horizontally opposed pistons. The pump assembly 400 has a pump cylinder 402 supported by the cylinder block 10 and surrounded by a cooling jacket 406 defined by a jacket wall 404. In the pump cylinder 402 are opposedly provided a pair of disk-like pump pistons 408 and 410 which are individually connected with push rods 412 and 414 which individually extend through openings 420 and 422 formed in end plates 416 and 418 which close opposite ends of the pump cylinder 402. The openings 420 and 422 are individually constructed as bearing openings which slidably and sealingly receive the push rods 412 and 414, respectively. By this arrangement the inside of the pump cylinder 402 is divided into three pump chambers 424, 426, and 428. The other end of the push rods 412 and 422 are, as better shown in FIG. 10, individually connected with O-members 430 and 432. As shown in FIG. 10 with respect to the connection between the push rod 412 and the O-member 430, the end of the push rod 412 is formed with a threaded portion 436 which is screwed into a correspondingly threaded opening 434 formed in the O-member 430, and the screw engagement is fixed by a pin 438. The O-members 430 and 432 individually have grooves 440 and 442 in which are individually engaged crankpins 444 and 446 which are individually supported by crank arms 448 and 450, each being constructed as a pair of crank arms. Crank cases 452 and 454 housing individually the crank mechanisms constructed by the aforementioned crank arms, etc. are connected with the crankcases 124, 224, and 126, 226 of the power assemblies 100 and 200, and furthermore these crankcases are connected with the inside of an air cleaner not shown in the figure by way of a positive crankcase ventilation valve also not shown in the figure so as to control pressure fluctuation in the crankcases.

The outlet of the carburetor 40 is connected with ports 456, 458, and 460 individually opening to the pump chambers 424, 426 and 428 by way of passages 60, 62, and 64, respectively. In these passages are individually provided reed valves 66, 68, and 70. The ports 458 and 460 are individually so positioned that they positively open individually to the pump chambers 426 and 428 without interfering with the pistons 408 and 410 even when these pistons have come to their BDC. The pump chamber 424 is connected with a mixture tank 22 by way of an outlet port 462 and a passage 72 so as to supply scavenging mixture to the first power cylinder-piston assembly 100 by way of the mixture tank. In the outlet port 462 is provided a reed valve 464. On the other hand, the pump chambers 426 and 428 are connected with a second mixture tank 24 by way of outlet ports 466 and 468 and passages 74 and 76, respectively, so as to supply scavenging mixture further through a passage 253 to the scavenging plenum 232 of the second power cylinder-piston assembly 200. In the ports 466 and 468 are individually provided reed valves 470 and 472.

The section taken along line VII—VII in FIG. 9 presents a view similar to that shown in FIG. 7. In this case, however, the reference numerals attached in FIG. 7 must be modified so that the first figure in each reference numeral is changed from "1" to "2". Since in this third embodiment crankcase compression is not involved either, the pressure in the mixture tanks 22 and 24 will change in the same manner as shown in FIG. 8 in accordance with reciprocating movement of the power pistons 108, 110 and 208, 210.

The ratio of the pumping stroke volume of the pumping chamber 424 to the stroke volume of the power cylinder-piston assembly 100 and the ratio of the sum of the pumping stroke volumes of the pumping chambers 426 and 428 to the stroke volume of the power cylinder-piston assembly 200 should be individually determined in the same manner as in the second embodiment. Also in this case it is possible to obtain an engine which satisfies the requirements with regard to engine performance and to the standard for exhaust gas purification in the desirable manner by limiting the ratio within the range of 1.35–1.85.

As the factors for determining the scavenging pressure in the period So–BDC–Sc in FIG. 8, not only the pump stroke volume and the volumes of tanks 22 and 24 but also the clearance volumes of pump chambers 424, 426 and 428, the volumes of passages 60, 62, 64, 72, 153, 74, 76, and 253 and the volumes of scavenging plenums 132 and 232 must be taken into consideration. In this connection, although it is desirable that the clearance volumes of the pump chambers 426 and 428 should be as small as possible, if it is so designed, the push rods 412 and 414 will be supported only like a cantilever when the pistons 408 and 410 are in their BDC and the structural stability and durability of the push rods and the related mechanisms will deteriorate. Such a problem can be obviated, if, for example, the end plates 416 and 418 are thickened or formed like a box so as to reduce the clearance volumes of the pump chambers 426 and 428. By taking this matter into consideration, in the shown embodiment, the pump chambers 426 and 428 are connected with the tank 24 by way of relatively short passages 74 and 76, while on the other hand the pump chamber 424 is connected with the tank 22 by way of a relatively long passage 72.

In the pump assembly 400 the reciprocating inertial force is relatively larger than the rotary inertia force. However, the reciprocating inertia force is internally cancelled and does not give any external effect. However, since the reciprocating inertia force is exerted to the bearing means, the crank arms are individually constructed as a pair of crank arms which support a crank pin therebetween and are supported by bearing means on opposite sides thereof.

Also in this third embodiment the operational phases of the individual pump chambers need not be shifted from the operational phases of the first and second power cylinder-piston assemblies 100 and 200 by an exact angle of 180°. Also in this case the operational phase of the pump may be shifted from that of the pump means by more than 180° up to approximately 195°, whereby scavenging performance in the latter half portion of the scavenging period can be improved.

Figure 11:
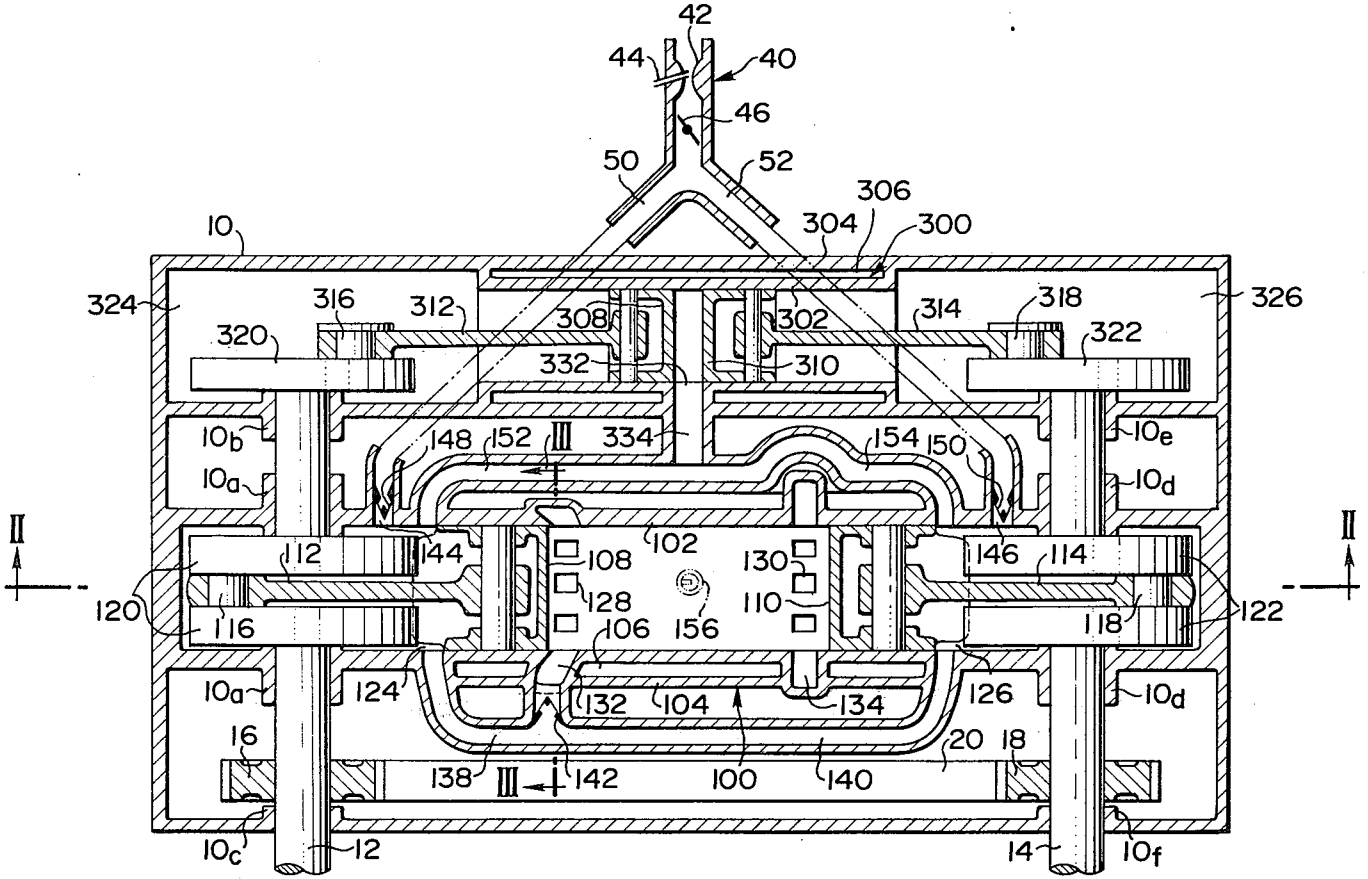
FIGS. 11 and 12 are diagrammatical plan views similar to FIG. 1, showing a fourth and a fifth embodiment of the present invention, respectively. Sectional views along line II-ii of FIGS. 11 and 12 are the same as that shown in FIG. 2.

FIG. 11 is a view similar to FIG. 1, showing a fourth embodiment of the present invention. In FIG. 11, the portions corresponding to those shown in FIG. 1 are designated by the same reference numerals as in FIG. 1. Furthermore, the sections taken along lines II—II and III—III in FIG. 11 are the same views as in FIGS. 2 and 3, respectively. This fourth embodiment is different from the first embodiment shown in FIG. 1 with respect to the method and the structure for suction and delivery of mixture of the scavenging pump assembly 300, which, in this assembly, is also a pump cylinder-piston assembly of the horizontally opposed piston type. As apparent from comparison of FIGS. 1 and 11, the power cylinder-piston assembly 100 and the pump cylinder-piston assembly 300 are not different between these two embodiments with regard to their own structures.

In the first embodiment shown in FIG. 1, the pump assembly 300 takes in mixture, in its suction stroke, from the carburetor 40 through the passage 48 including the reed valve 330, and the flow of mixture discharged from the pump assembly 300 in its compression stroke pushes the reed valve 336 open and flows through the passages 334, 152 and 154 toward the crankcases 124 and 126. By contrast, in the fourth embodiment shown in FIG. 4, the passage 48 for directly supplying mixture from the carburetor 40 to the pump assembly 300 and the reed valve 336 in the passage 334 are eliminated. In this embodiment, therefore, the pump assembly 300 takes in mixture, in its suction stroke, from the crankcases 124 and 126, through the passages 334, 152 and 154, and it discharges mixture, in its compression stroke, so as to push it back through the same passage. This fourth embodiment has some advantages and disadvantages when compared with the first embodiment shown in FIG. 1. In the first embodiment the pump assembly 300 draws in mixture, in its suction stroke, through a relatively short passage such as 48, while on the other hand in the fourth embodiment the pump assembly 300 has to draw in mixture, in its suction stroke, through a relatively long passage composed of passages 50, 52, crankcases 124, 126, passages 152, 154 and passage 334, whereby the flow resistance is high and the volumetric efficiency of the pump is lowered. On the other hand, however, in the compression and the delivery strokes of the pump assembly 300, in the first embodiment the mixture must flow through the reed valve 336, which involves a certain flow resistance which will cause a certain pressure loss of the mixture, while in the fourth embodiment such a reed valve is eliminated thereby causing no such pressure loss. Furthermore, in actual structure a reed valve includes a relatively large clearance volume, and, in addition, when the reed valve 336 is provided in the passage 334, this passage cannot actually be so short as diagrammatically shown in FIG. 1, whereby the clearance volume involved in the portion of the passage 334 will actually be substantially large. There are no such problems in the embodiment shown in FIG. 11. Furthermore, with respect to the piping structure at the outlet of the carburetor 40, the fourth embodiment has the advantage over the first embodiment in that it is much simpler. However, in spite of these advantages and disadvantages, it will be apparent that the fourth embodiment shown in FIG. 11 has substantially the same performance as the first embodiment shown in FIG. 1, and that this fourth embodiment can be designed in the same manner as explained with respect to the first embodiment.

Also in this embodiment the operational phases of the pump pistons 308 and 310 of the pump assembly 300 need not be shifted from those of the power pistons 108 and 110 of the power assembly 100 by an angle of exactly 180°. In this case also the phase difference may be in the range of 180° to approximately 195° so that the scavenging performance in the latter half portion of the scavenging period is further improved.

Figure 12:
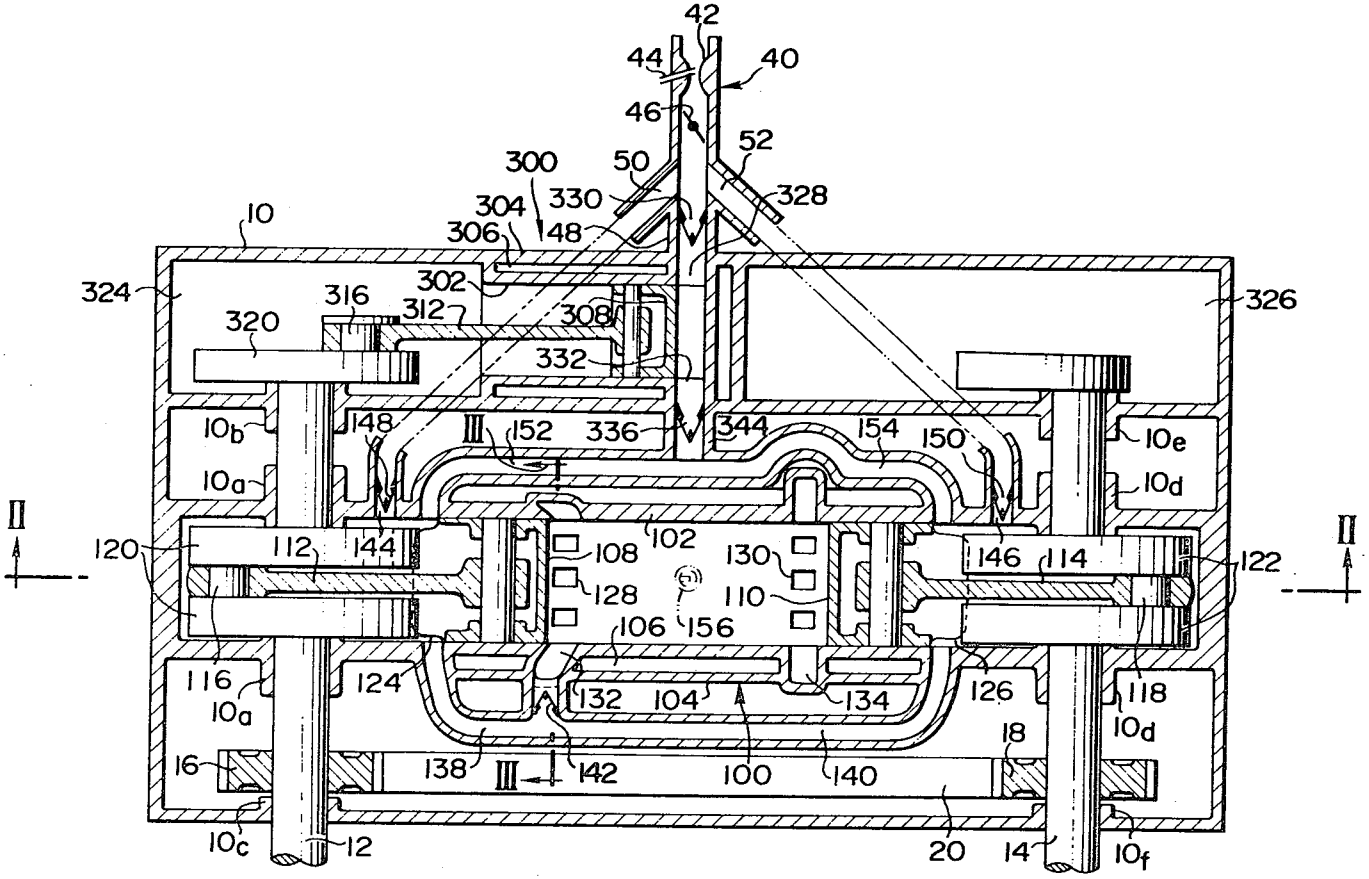

FIG. 12 is a view similar to FIG. 1, showing a fifth embodiment of the present invention. In this embodiment the pump assembly 300 is constructed as a single piston reciprocating type pump cylinder-piston assembly. As apparent from FIG. 12 the engine herein shown has the structure in which the right half portion of the pump assembly 300 in the first embodiment shown in FIG. 1, i.e. substantially a half of the pump cylinder 302, piston 310, connecting rod 314, crankpin 318 and crank arm 322, have been deleted. In FIG. 12 the portions corresponding to those shown in FIG. 1 are designated by the same reference numerals, and these corresponding portions operate in the same manner in both embodiments. When such a single piston pump assembly is employed, there are disadvantages with regard to the dimensions of the pump piston relative to the power piston and dynamic balance of the pump assembly when compared with a pump assembly of the horizontally opposed piston type, as explained hereinabove. However, in this case the manufacturing cost is reduced, and when the engine is small sized the balance and dimensional disadvantages can be sufficiently compensated for by the cost advantage.

Since the structure and operation of other portions of the embodiment shown in FIG. 12 are substantially the same as those of the embodiment shown in FIG. 1, detailed description for those will be omitted in order to avoid duplication.

Although the invention has been shown and described with respect to some preferred embodiments thereof, it should be understood by those skilled in the art that various changes and omissions of the form and detail thereof may be made therein without departing from the scope of the invention.

We claim:

1. A two-stroke cycle gasoline engine, comprising:

(a) at least one two-stroke cycle power cylinder-piston assembly incorporating uniflow scavenging and two horizontally opposed pistons;

(b) a pair of crankcases and crank mechanisms housed in said crankcases operatively associated with said power cylinder-piston assembly;

(c) a scavenging pump means including:

(1) at least one pump cylinder-piston assembly of the reciprocating type driven by said power cylinder-piston assembly in synchronization therewith; and (2) reciprocating piston pump structures including said crankcases and crank mechanisms;

(d) a carburetor;

(e) first passage means for supplying fuel-air mixture from said carburetor individually to said pump cylinder-piston assembly and to said pair of crankcases;

(f) second passage means for supplying fuel-air mixture from said pump cylinder-piston assembly to said pair of crankcases; and (g) third passage means for supplying fuel-air mixture from said pair of crankcases to said power cylinder-piston assembly, wherein the total stroke volume of said scavenging pump means is between 1.35 and 1.85 times as large as that of said power cylinder-piston assembly, and the operational phase of said pump cylinder-piston assembly is so shifted relative to that of the power cylinder-piston assembly to which it supplies scavenging mixture, that when the power cylinder piston assembly is at its bottom dead center the pump cylinder-piston assembly is in a range between its top dead center and a phase point which is slightly before the top dead center.

2. The engine of claim 1 wherein said two-stroke cycle power cylinder-piston assembly includes a power cylinder in which said pistons are disposed, said power cylinder having scavenging ports proximate one axial end thereof and exhaust ports proximate the other axial end thereof so as to perform uniflow scavenging, said scavenging ports being arranged substantially symmetrically around the central axis of said power cylinder so as to generate a substantially uniform, cylindrical, spiral flow of scavenging mixture through said power cylinder, and wherein said scavenging ports and exhaust ports are so arranged in said power cylinder that said exhaust ports opened before said scavenging ports are opened and said exhaust ports and closed after said scavenging ports have been closed.

3. The engine of claim 1, wherein said pump cylinder-piston assembly of the reciprocating type has two horizontally opposed pistons.

4. The engine of claim 1, wherein said pump cylinder-piston assembly of the reciprocating type has a single pump piston.

5. The engine of any one of the claims 3, 4, or 1, wherein the retardation of the operational phase of said pump cylinder-piston assembly relative to that of said power cylinder-piston assembly is between 180° and 195° by crank angle.

6. The engine of any one of the claims 3, 4, or 1, wherein said power cylinder-piston assembly and said pump cylinder-piston assembly are horizontally arranged side by side and have a pair of common crankshafts arranged along opposite ends of the assemblies.

7. The engine of claim 6, further comprising a pair of sprocket wheels individually mounted on said pair of crankshafts and an endless chain engaged around said pair of sprocket wheels so that said pair of crankshafts are drivingly connected with each other so as to rotate in the same direction in synchronization with each other.

* * * * *